United States Patent [19]

Schmanski

[11] 4,285,134

[45] Aug. 25, 1981

[54] SHINGLE LOCATING GAUGE

[76] Inventor: Thomas G. Schmanski, 25925 Mackinac, Roseville, Mich. 48066

[21] Appl. No.: 166,759

[22] Filed: Jul. 7, 1980

[51] Int. Cl.[3] ..... G01B 3/30; G01B 5/16

[52] U.S. Cl. ..... 33/188; 33/187

[58] Field of Search ..... 33/188, 411, 187

[56] References Cited

U.S. PATENT DOCUMENTS

| | | | |
|---|---|---|---|
| 338,156 | 3/1886 | Johnson | 33/187 |
| 1,586,946 | 6/1926 | Carr | 33/188 |
| 2,157,663 | 5/1939 | Giebink | 33/188 |
| 3,110,113 | 11/1963 | Baker | 33/188 |
| 3,490,152 | 1/1970 | Printz | 33/188 |

*Primary Examiner*—Willis Little

*Attorney, Agent, or Firm*—Harness, Dickey & Pierce

[57] ABSTRACT

A shingle locating gauge for use in aligning and applying roofing or siding shingles has a pair of generally parallel side supports attached to an elongated alignment guide. A load spreading bar and an elongated support member extend generally parallel to the alignment guide and are each connected to the side supports. Mounted on the support member are a pair of alignment stops and a clamp adapted to apply force against the load spreading bar.

7 Claims, 5 Drawing Figures

SHINGLE LOCATING GAUGE

BACKGROUND AND SUMMARY OF THE INVENTION

The present invention relates to gauge devices for laying roofing or siding shingles in overlapping relationship and in proper alignment. More particularly, the present invention relates to a shingle gauge which facilitates the process of laying a new course of shingles without damaging the course of shingles previously laid.

The laborious nature of the process of applying shingles to a roof or side of a building is well known. Not only is the physical labor demanding, but the shingling process is often carried out by persons who are exposed to uncomfortably high or low temperature conditions yet must do accurate work. It is necessary that the shingles or courses of the shingles be accurately spaced and aligned with respect to each other to have a roof or sidewall of satisfactory appearance. Various methods and devices have been proposed and used in the past to facilitate the proper positioning of shingles, but there remains a need for an improved device which facilitates the alignment of shingles without damaging previously laid shingles. It would, of course, also be desirable if the device were adjustable or adaptable to accommodate shingles of various lengths, widths and thicknesses. It would be further desirable if the device could be employed on vertical surfaces.

Thus, in accordance with the present invention, a shingle locating gauge is provided which has a shingle alignment guide connected to adjustable means for locating the guide with respect to a previously laid course of shingles. The means for locating the shingle alignment guide includes a load spreading bar, and an elongated support member, both extending generally parallel to the alignment guide. The support member carries a pair of spaced apart U-shaped alignment stops and a clamping mechanism which cooperate with the load spreading bar to align and locate the shingle locating gauge with respect to a previously applied course of shingles.

DESCRIPTION OF THE INVENTION

Figures 1, 2, 3, 4, 5:
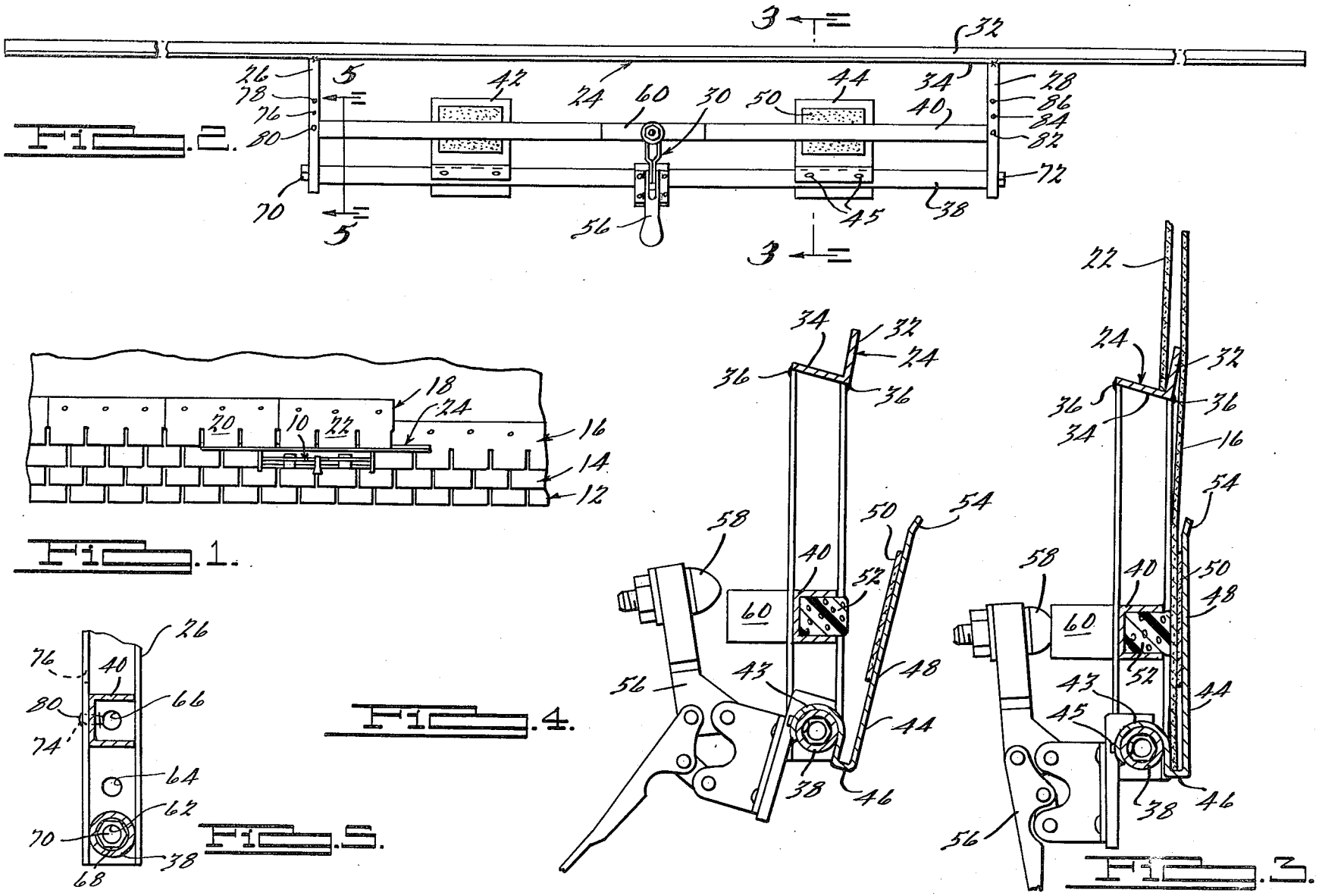
FIG. 1 is a top plan view of a shingle locating gauge of the present invention on a partially shingled roof, shown broken away, illustrating the gauge in use.
FIG. 2 is a top plan view of the shingle locating gauge of FIG. 1.
FIG. 3 is a sectional view of the shingle locating gauge of FIG. 2 taken along line 3—3 in FIG. 2 but with shingles added to illustrate the clamping mechanism in a clamping position.
FIG. 4 is a sectional view similar to that of FIG. 3, but showing the clamping mechanism in a not clamping position and with shingles removed.
FIG. 5 is a sectional view taken along line 5—5 in FIG. 2.

Now referring to the figures, a preferred embodiment of a shingle locating gauge of the present invention is shown and indicated generally by the numeral 10. FIG. 1 illustrates shingle locating gauge 10 in use on a roof with three courses 12, 14, and 16 of shingles previously applied to the roof and a course 18 of shingles in the process of being applied. The shingles of courses 12, 14, 16, and 18 are conventional, three tab strip shingles. Course 18 is shown with shingles 20 and 22 supported and aligned by shingle locating gauge 10 which has been clampingly positioned on a portion of course 16. The next shingle to be applied to the roof would be a shingle of course 18 which would be positioned to the right of shingle 22, as viewed in FIG. 1, and would be supported on the rightward portion of shingle gauge 10 in a manner analogous to that of shingles 20 and 22. Further shingles of course 18 would be aligned or located for application by unclamping shingle gauge 10 and repositioning shingle gauge 10 to the right as viewed in FIG. 1. With the particular embodiment of shingle gauge 10 shown in the Figures, three new shingles can be applied for each position of shingle gauge 10.

Broadly speaking, and as is best shown in FIG. 2, shingle gauge 10 comprises a shingle alignment guide 24 which is attached by means of side supports 26 and 28 to adjustable means, designated generally by the numeral 30, for locating the shingle alignment gauge with respect to a previously applied course of shingles.

Shingle alignment guide 24 is an elongated member, such as a piece of angle iron, but preferably an L-shaped extrusion of aluminum or other light weight material, which has a flange 32 and a flange 34 at a right angle thereto. The length of shingle alignment guide 24 should be sufficiently long to allow more than one shingle to be aligned by shingle alignment gauge 10 without change of position thereof but should not be so long as to make shingle alignment gauge 10 unwieldly and difficult to move and handle. A suitable length for shingle alignment guide 24 is illustrated in FIG. 1 wherein shingle alignment guide 24 has a length approximately equal to the width of two shingles and thus can be used as shown in FIG. 1, to locate three shingles at each position of shingle gauge 10.

Shingle alignment guide 24 is attached to side supports 26 and 28 as by welds 36 or the like and is positioned so that flange 32 is canted at an angle of from about 12° to 15° with respect thereto. Thus, as viewed in FIG. 3, the uppermost edge of flange 32 lies on a plane slightly to the right of side supports 26 and 28. As is illustrated in FIG. 3, the uppermost edge of flange 32 presses against a midpoint of shingles of course 16 to bend each shingle inwardly toward the roof. This is highly beneficial in providing previously laid shingle portions which lie flat against the roof, over which the new shingles are to be applied.

Side supports 26 and 28 are elongated channel shaped members, preferably made of light weight material such as extruded aluminum or the like. It will be understood that side supports 26 and 28 are of the same construction and extend generally parallel to each other with facing channel openings.

Disposed between side support 26 and 28 and adjustably connected thereto is means 30 for locating shingle gauge 10 with respect to a previously applied course of shingles. Broadly speaking, means 30 comprises elongated support member 38 and load spreading bar 40, both of which extend generally parallel to alignment guide 24 and are disposed between supports 26 and 28, and clamp 56.

Support member 38 is rotatably connected to supports 26 and 28 and is tubular in construction, although the exact cross-sectional shape is not critical. Support member 38 carries a pair of spaced, generally U-shaped alignment stops 42 and 44. Alignment stop 42 is positioned on one end portion of support member 38 while alignment stop 44 is positioned on the opposite end portion thereof to obtain lateral spacing therebetween. Each alignment stop 42 and 46 functions as alignment means as well as a part of the clamping means. Each of alignment stops 42 and 44 are spaced apart so as to spread the clamping pressure on a course of shingles 16 and also so as to have a reversely bent stop portions laterally spaced so as to maintain shingle alignment guide 24 in parallel relationship to the lower edge of course 16 of shingles.

Each alignment stop 42 and 46 is of identical construction. Thus, it will be appreciated that the following description of alignment stop 44 is fully applicable to alignment stop 42. Also, it will be understood that as used herein, the terms upwardly and downwardly are with respect to the position of shingle gauge 10 as viewed in the Figures, and the terms inwardly and outwardly indicate toward or away from shingle locating gauge 10 itself.

Alignment stop 44 has an end portion 43 which is fixedly secured to support member 38 by a plurality of rivets 45 or other fastening means. Alignment stop 44 has an intermediate, reversely bent portion 46 and an upwardly extending portion 48, as viewed in FIG. 3, with an outwardly bent edge 54 to facilitate sliding of alignment stop 44 underneath a previously applied shingle. It will be appreciated that reversely bent portion 46 provides a channel within which a lower edge of a previously applied shingle can be received and provides a stop means limiting upward positioning of aligment stop 44 and hence, shingle alignment gauge 10 with respect thereto. The inward side of upwardly extending portion 48 carries a friction pad 50, such as sandpaper or the like, adhesively secured thereto to facilitate gripping of the shingles. Thus, a portion of a shingle of course 16 can be clampingly secured between pad 50 of alignment stop 44 and a resilient material 52 such as polyethylene foam or the like, filling an opposing portion of the channel of load spreading bar 40.

Clamp 56 provides clamping force between upwardly extending portion 48 of alignment stop 44 and resilient material 52 positioned in load spreading bar 40. Clamp 56 is preferably a locking-type toggle clamp such as a model 215U DE-STA-CO clamp available from DE-STA-CO Division of Dover Corporation. Clamp 56 is secured to support member 38 which is rotatably disposed with respect to side supports 26 and 28. Thus, movement of toggle clamp 56 to a closed or locked position causes movement of nib 58 toward raised portion 60 on load spreading bar 40. Upon contact with raised portion 60, toggle clamp 56 causes a rotation of support member 38 urging pad 50 toward or against resilient material 52 or a shingle portion therebetween.

It is important to note that only a single toggle clamp 56 is required for use with the present invention since the force applied by toggle clamp 56 is spread by load spreading bar 40 to oppose clamping force transmitted by means of support member 38 to alignment stops 42 and 44.

Shingle alignment gauge 10 can be adjusted so as to be used with shingles having various thicknesses as well as widths. Thus, toggle clamp 56 can have a rubber nib 58 which is adjustable to select the amount of rotation of support member 38.

In addition, the positions of load spreading bar 40 and support member 38 with respect to shingle alignment guide 24 are adjustable. Adjustment of load spreading bar 40 and support member 38 along side supports 26 and 28 changes the spacing of reversely bent portion 46 of alignment stops 42 and 44 with respect to shingle alignment guide 24. This allows use of shingle alignment gauge 10 with shingles of various widths. As is best shown in FIGS. 2 and 5, a plurality of apertures are provided in side supports 26 and 28 to accommodate various positions of support member 38 and load spreading bar 48. Thus, side support member 26 carries apertures 62, 64 and 66 to provide three positions for support member 38 to be secured thereto as by threaded bolt 70 extending through aperture 62 and threadably engaging nut 68 fixedly secured in the inner diameter of support member 38. The rightward end of support member 38 is secured in an analogous manner to side support 28. Side support 26 has a plurality of apertures 74, 76, and 78 and load spreading bar 40 is secured to side support 26 by threaded element 80 which extends through aperture 74 and threadably engages an aligned aperture in the web of load spreading bar 40. Analogous apertures 82, 84 and 86 are provided in side support 28 for the rightward end of load spreading bar 40.

It will be appreciated by those skilled in the art that the shingle locating gauge made in accordance with the present invention is well adapted to be used on vertical roofs or walls as well as on horizontally disposed or inclined roofs or walls. In addition, use of the shingle locating gauge of this invention is unlikely to cause damage to the surface of shingles or siding on the roof or wall. Of course, only one clamp must be manipulated in use of the present invention even though the clamping force is spread over a large area by means of the load spreading bar. The shingle locating gauge is light weight and easy to manuever but can support a considerable load. The pair of alignment stops provide for accurate positioning of the shingle locating gauge to further facilitate and provide accuracy during use thereof.

Thus, it will be appreciated that the preferred embodiment of the present invention disclosed hereinbefore has many advantages. However, it will also be appreciated that the present invention is subject to modification and variation without departing from the scope thereof.

For example, it is contemplated that the shingle locating gauge 10 of the present invention may also be provided with a second shingle alignment guide which, when in position, would be spaced above the first shingle alignment guide 24. This would allow for placement of two courses of shingles before having to reposition the shingle locating gauge 10. The second shingle alignment guide may include support arms appropriately placed over its width and rotatably mounted on load spreading bar 40 so that when not in use, the second shingle alignment guide could be moved out of position by rotating the support arms about load spreading bar 40, thus allowing the second shingle alignment guide and support arms to assume a horizontal position. Therefore, it is intended that the present invention be limited only by the appended claims.

What is claimed is:

1. A shingle locating gauge for use in aligning and applying roofing or siding shingles comprising:

an elongated alignment guide adapted to support the lower edges of shingles being applied;

a pair of generally parallel, elongated side supports attached to said alignment guide and extending therefrom;

a load spreading bar extending generally parallel to said alignment guide and connected to each of said side supports; and an elongated support member extending generally parallel to said alignment guide and rotatably connected to each of said side supports, said elongated support member having a clamp mounted thereon for applying force against said load spreading bar and further having a pair of spaced apart alignment stops mounted thereon for aligning said member with respect to a course of previously applied shingles, each of said alignment stops including a U-shaped portion adapted to receive an edge portion of a previously applied shingle and an upwardly extending portion in opposition to a portion of said load spreading bar.

2. A shingle locating gauge as in claim 1 wherein said alignment guide has an L-shaped cross-section and is mounted on said side supports such that an outward edge portion is out of the plane thereof.

3. A shingle locating gauge as in claim 2 wherein each of said upwardly extending portions carries a friction pad on an inwardly facing portion thereof and wherein said load spreading bar is of channel-shaped cross-section and has a resilient pad disposed substantially within said channel in opposition to each of said friction pads.

4. A shingle locating gauge as in claim 3 wherein said clamp is a locking clamp.

5. A shingle locating gauge as in claim 4 wherein said alignment guide, side supports, support member and load spreading bar comprise aluminum.

6. A shingle locating gauge as in claim 4 including means for adjustably attaching each of said support members and said load spreading bar to said side supports.

7. A shingle locating gauge as in claim 6 wherein said means for adjustably attaching each of said support member and said load spreading bar to said side supports includes a plurality of apertures in each of said side supports.

* * * * *